US010801812B2

(12) United States Patent
Buchsbaum

(10) Patent No.: US 10,801,812 B2
(45) Date of Patent: Oct. 13, 2020

(54) BORESIGHT ALIGNMENT DEVICE FOR AIMING SYSTEMS

(71) Applicant: Meopta U.S.A., Inc., Trinity, FL (US)

(72) Inventor: Philip E. Buchsbaum, Oldsmar, FL (US)

(73) Assignee: Meopta U.S.A., Inc., Trinity, FL (US)

( * ) Notice: Subject to any disclaimer, the term of this patent is extended or adjusted under 35 U.S.C. 154(b) by 0 days.

(21) Appl. No.: 16/699,200

(22) Filed: Nov. 29, 2019

(65) Prior Publication Data

US 2020/0182589 A1 Jun. 11, 2020

Related U.S. Application Data

(60) Provisional application No. 62/775,943, filed on Dec. 6, 2018.

(51) Int. Cl.
*F41G 1/54* (2006.01)
*F41G 1/34* (2006.01)

(52) U.S. Cl.
CPC ..... *F41G 1/545* (2013.01); *F41G 1/345* (2013.01)

(58) Field of Classification Search
CPC . F41G 1/54; F41G 1/545; F41G 3/323; F41G 3/32
See application file for complete search history.

(56) References Cited

U.S. PATENT DOCUMENTS 5,438,404 A * 8/1995 Hamilton ..... F41G 3/323 356/141.1

* cited by examiner

*Primary Examiner* — J. Woodrow Eldred
(74) *Attorney, Agent, or Firm* — Dennis L. Cook, Esq.

(57) ABSTRACT

A boresight alignment system for an aiming device that aligns the bore of the weapon to the optics, in this case the reticle, by incorporating the use of a HUD to produce the reticle in an aiming device, thus allowing electronic adjustment of the reticle that can be stored in the aiming devices memory and eliminating the necessity for manual adjustments of azimuth and elevation settings is disclosed.

4 Claims, 2 Drawing Sheets

BORESIGHT ALIGNMENT DEVICE FOR AIMING SYSTEMS

CROSS-REFERENCE TO RELATED APPLICATION

The present application claims the benefit of previously filed Provisional patent application, Ser. No. 62/775,943, filed on Dec. 6, 2018.

FIELD OF THE INVENTION

The method of this disclosure belongs to the field of aiming systems. More specifically it is a boresight alignment system that aligns the bore of the weapon to the aiming device's optics, in this case the reticle in the aiming device's optics is produced by the use of a Heads Up Display (HUD) in the aiming device that can be stored in the aiming device's memory and thus eliminates the necessity for manual azimuth and elevation settings.

BACKGROUND OF THE INVENTION

A weapon that fires projectiles typically includes a firing system having a barrel through which the projectiles are fired and an aiming device such as a scope or reflex sight used to aim the weapon. The aiming device often includes a sight through which a user can observe the direction that the barrel is pointing or see the point at which the barrel's muzzle is aimed. The sight of the weapon may sometimes include a scope or reflex sight with crosshairs called the reticle.

Boresighting or boresight alignment refers to the process of calibrating an aiming system, such as by calibrating the sight of a weapon so that the crosshairs or reticle of the scope or reflex sight align with a spot where the barrel muzzle is pointing. This is normally done on the range or dry boresighter and requires a manual adjustment of elevation and azimuth on the aiming device.

Thus there's the need for the novel approach of this disclosure that eliminates the need for manual adjustment of elevation and azimuth settings when boresighting an aiming device by incorporating a HUD in the aiming device to produce the reticle thus allowing electronic adjustment of the reticle that can then be stored in the aiming devices memory.

BRIEF SUMMARY OF THE INVENTION

What is disclosed is a boresight alignment system that aligns the bore of the weapon to the optics, generally the reticle in an aiming device, by incorporating the use of a HUD to produce the reticle in the aiming device, thus allowing electronic adjustment of the reticle that can be stored in the aiming device's memory and eliminating the necessity for manual adjustments of azimuth and elevation settings.

BRIEF DESCRIPTION OF THE DRAWINGS

For a fuller understanding of the nature and objects of the invention, reference should be made to the following detailed description, taken in connection with the accompanying drawings, in which.

DESCRIPTION OF THE PREFERRED EMBODIMENT

Figure 1:
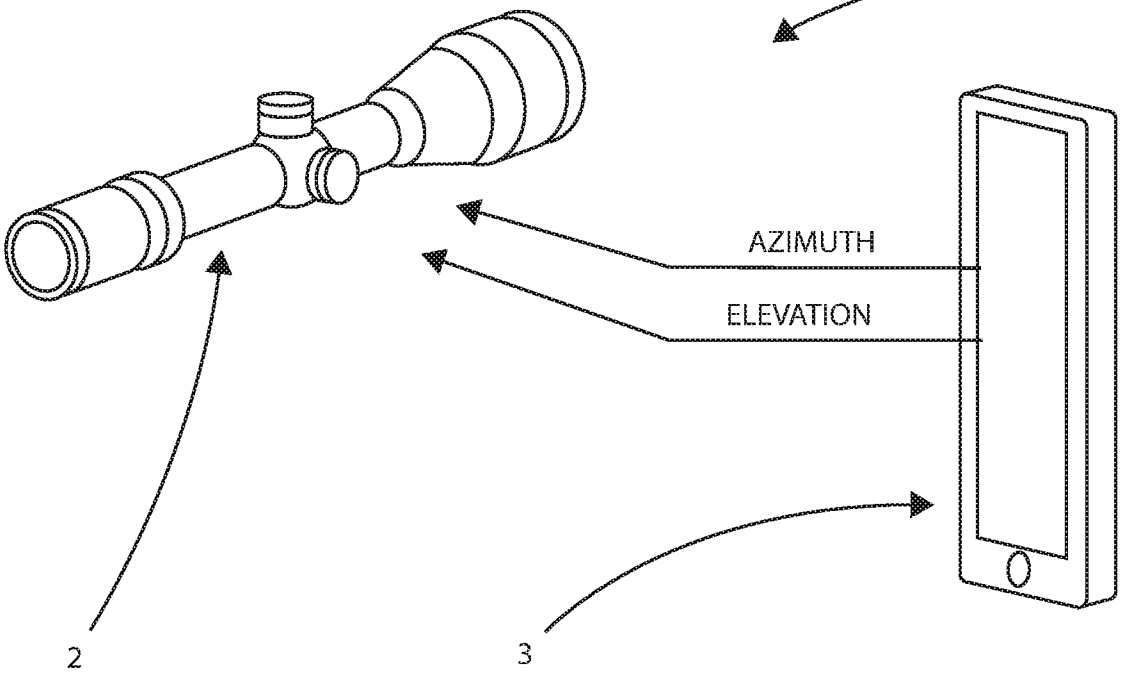
FIG. 1 shows a general concept diagram of the boresight alignment system of this disclosure; and, FIG. 2 shows a preferred embodiment optical-mechanical diagram of the reflex sight aiming system of this disclosure.

As discussed above and shown in FIGS. 1 and 2 the boresight alignment system (1) for an aiming device (2) of this disclosure is useful for aligning the bore of the weapon (not shown) to the optics, in this case the reticle (5), by incorporating the use of a Heads Up Display (HUD) (4) to produce the reticle (5) in an aiming device (2) that can be stored in the aiming device's memory in its electronics (7) and/or mobile phone (3), thus eliminating the necessity for manual adjustments of azimuth and elevation settings of the aiming device (2).

Figure 2:
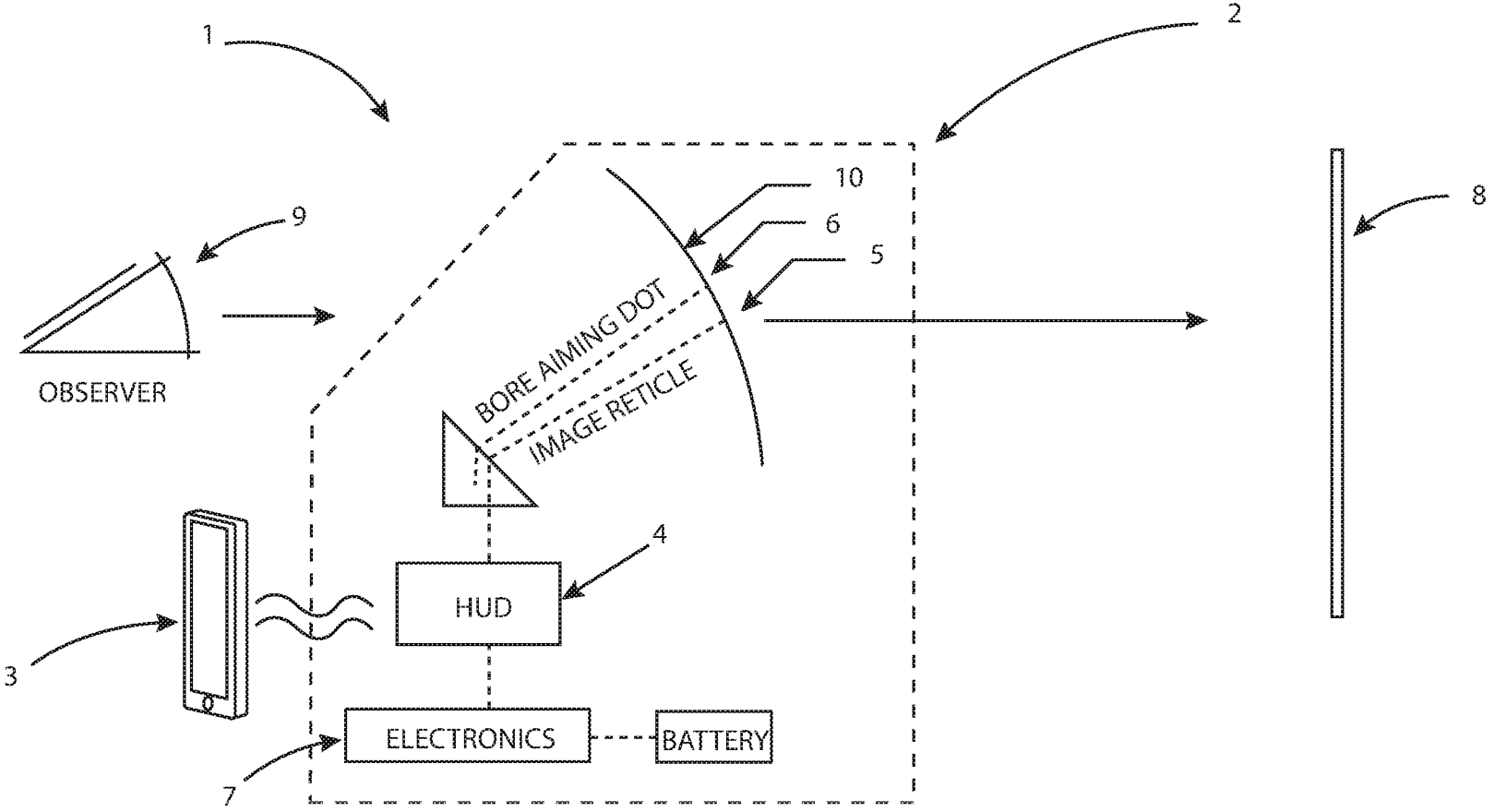

As shown in the preferred embodiment diagram of the boresight alignment system (1) of FIG. 2, the novel idea of this disclosure includes an HUD Application on a mobile phone (3) that communicates via Bluetooth or Wi-Fi with the reticle (5) pixel producing HUD (4) located inside the aiming device (2), thus remotely adjusting the Azimuth and Elevation associated with the pixelated reticle (5) aiming point of the aiming device (2), to align with an aiming spot (6) where the barrel muzzle is pointing at a target/grid (8) once its been determined on the range or dry boresighter. This alignment information can then be stored the in the aiming device's (2) electronics' (7) memory and/or in a HUD Application on the mobile phone (3) for use in the future any time that particular aiming device (2) is used with that particular weapon.

As a further illustration of the boresight alignment system (1) of the present invention a rifle scope aiming device (2) is boresighted to a weapon bore as follows: First the aiming device (2) is attached to a weapon and the weapon is then placed into a holding device that secures the weapon while the aiming device (2) is being boresighted. The boresighting procedure begins with the user (9) either sighting through the bore at a grid or target (8) some set distance away or using a laser pointing device inserted in the bore to sight the bore to a specific point on the grid or target. Next the Heads Up Display application is started on the mobile phone (3) and connects via Wi-Fi- or Bluetooth to the aiming device (2). Viewing the reticle (5) produced on the optics (10) in the aiming device (2) by the Heads up Display (4) on the screen of the mobile phone (3) the user can then use adjustment scrolls or similar mechanisms to move the produced reticle (5) into alignment with the grid or target (8) aiming spot (6) thus completing the boresighting procedure. Finally, the position of the reticle is stored in the aiming device's (2) memory in the HUD electronics (7) and/or in the HUD application on the mobile phone (3).

Since certain changes may be made in the above described boresight alignment system of this disclosure without departing from the scope of the invention herein involved, it is intended that all matter contained in the description thereof or shown in the accompanying figures shall be interpreted as illustrative and not in a limiting sense.

What is claimed is:

1. A boresight alignment system that aligns the bore of a weapon to an aiming device's optics comprising:

a Heads Up Display located within an aiming device;

said Heads Up Display capable of producing a pixelated reticle on said aiming device's optics in said aiming device;

said Heads Up Display capable of electronic adjustment of the Azimuth and Elevation of said pixelated reticle; and, said Heads Up Display's pixelated reticle adjustments capable of being stored in an electronic memory in said aiming device.

2. The boresight alignment system of claim 1 wherein said aiming device is a reflex sight.

3. The boresight alignment system of claim 1 including a mobile phone running a Heads Up Display Application that is in communication with said Heads Up Display located within said aiming device such that said mobile phone can adjust the Azimuth and Elevation of said pixelated reticle and wherein said mobile phone has an electronic memory that is capable of storing said Heads Up Display's Azimuth and Elevation pixelated reticle adjustments.

4. The boresight alignment system of claim 3 wherein said aiming device is a reflex sight.

* * * * *